US008918947B2

(12) United States Patent
Schwartz

(10) Patent No.: US 8,918,947 B2
(45) Date of Patent: Dec. 30, 2014

(54) CREVICE TOOL FOR VACUUM CLEANERS

(71) Applicant: Michael N. Schwartz, Webster Groves, MO (US)

(72) Inventor: Michael N. Schwartz, Webster Groves, MO (US)

( * ) Notice: Subject to any disclaimer, the term of this patent is extended or adjusted under 35 U.S.C. 154(b) by 0 days.

(21) Appl. No.: 13/986,838

(22) Filed: Jun. 10, 2013

(65) Prior Publication Data

US 2013/0326843 A1 Dec. 12, 2013

Related U.S. Application Data

(60) Provisional application No. 61/689,727, filed on Jun. 12, 2012.

(51) Int. Cl.
*A47L 9/02* (2006.01)

(52) U.S. Cl.
CPC ..... *A47L 9/02* (2013.01)
USPC ..... 15/246.2; 15/415.1; 15/416

(58) Field of Classification Search
CPC ..... A47L 5/28; A47L 9/06; A47L 9/248
USPC ..... 15/246.2, 415.1–422.1
IPC ..... A47L 9/20
See application file for complete search history.

(56) References Cited

U.S. PATENT DOCUMENTS

| | | | | |
|---|---|---|---|---|
| 4,694,529 | A | 9/1987 | Choiniere | |
| 4,715,088 | A * | 12/1987 | Haase | 15/422.1 |
| 5,535,477 | A * | 7/1996 | Witkowski | 15/395 |
| 5,655,257 | A * | 8/1997 | Chavez | 15/396 |
| 6,032,328 | A * | 3/2000 | Harmon et al. | 15/421 |

* cited by examiner

*Primary Examiner* — David Redding
(74) *Attorney, Agent, or Firm* — Paul M. Denk

(57) ABSTRACT

The present invention refers to a crevice tool for vacuum cleaners as a singular component, comprising a socket transitioning into a long, flat air chamber, at an angle of approximately 45 degrees, wherein the air chamber (wand) incorporates both air suction slots and protruding nubs on both the top and bottom of the tool, and lateral slits in the end opposite the socket end. The various components of the crevice tool may be fabricated into kit form, and may include an adaptor, an extension, and a paw like terminal end, that can be used for removing any debris from tight areas.

9 Claims, 3 Drawing Sheets

CREVICE TOOL FOR VACUUM CLEANERS

CROSS REFERENCE TO RELATED APPLICATION

This non-provisional patent application claims priority to the provisional patent application having Ser. No. 61/689,727, filed on Jun. 12, 2012.

FIELD OF THE INVENTION

The present invention refers to a crevice tool for vacuum cleaners that comprises a socket extending into a flat air channel.

BACKGROUND OF THE INVENTION

Crevice tools for vacuum cleaners are already known in the art. One example of these already known tools is shown in U.S. Pat. No. 4,694,529, filed on May 6, 1986. FIG. 1 shows the referenced tool, where one can see that the only suction openings are located near and at the end of the tool. Therefore, as the tools are inserted into a narrow opening in need of cleaning typical debris, the tool will suck only that debris which lies directly at the opening.

Another example of these already known tools is the typical, rigid plastic, tubular vacuum cleaner, while the opposing end is an angled opening in a rectangular shape, at the suction slot. This tool is extremely limited in its use for vacuuming in narrow spaces, in that it will only remove debris located directly in front of the suction slot. This tool has been in use for many years, and many are produced under no patent.

One shortcoming of the prior art consists of the fact that the debris not directly in front of the opening will not be removed from the space intended to be vacuumed. Therefore the user must direct the tool's opening in front of the entire area needing vacuuming.

Another shortcoming is that the tool is comprised of relatively smooth plastic that will slide over debris, such as pet hair, small pieces of paper, etc. without dislodging the debris.

SUMMARY OBJECTIVES AND ADVANTAGES OF THE INVENTION

The present invention provides an effective vacuum attachment for efficiently removing dirt, dust, and other debris from narrow spaces typically found in, but not limited to, homes, offices, and other buildings which contain multiple numbers of said narrow spaces. The angle at which the attachment is formed will enable the tool to be used from a different angle of approach than being in direct parallel to the narrow space in need of vacuuming. The angle may be between about 0° to 60°. Such as standing in front of a piece of furniture, sliding the tool in a back and forth motion, as opposed to needing to get down on the floor; sliding the tool between a piece of furniture and a wall also without needing to move the furniture for putting the vacuum hose against the wall.

It is specially designed with the task of cleaning debris from in between refrigerator expansion coils found under many typical household refrigerators, where the clearance between coils is only ⅝".

As such, those skilled in the art will appreciate that conception, upon which this disclosure is based, may readily be utilized as a basis for the designing of other structures, methods, and devices for carrying out the several purposes of the present invention. It is imperative, therefore, that the claims be regarded as including such equivalent constructions insofar as they do not depart from the spirit and the scope of the present invention.

It is, therefore, the main objective of this invention to provide a much needed improved tool for removing dirt, dust, and debris from narrow spaces which, thus far, have been cleaned using awkward, clumsy, and inefficient standard vacuum cleaner attachments in combination with narrow brushes; or moving large, heavy objects, such and couches and refrigerators in order to vacuum under them.

The present invention has the objective of effectively removing all debris from any narrow area using cursory sweeping motions, without the user concentrating the tool in an acute manner. This objective is achieved by the three elements of the tool that are unique to its design. The tool incorporates nubs on the top and bottom which will grab and scrape debris stuck on surfaces, dislodging the debris to allow the suction, supplied by the vacuum cleaner to which the tool is attached, to remove the debris from the area through the multiple slots through the individual air channels and into the vacuum cleaner.

Thus, by using the crevice tool in accord with the invention, the user can remove unwanted debris from areas including, but not limited to, behind refrigerators where there is access to one or more sides of the refrigerator, without having to move the refrigerator; under refrigerators where there is an access panel in front, at the bottom of the refrigerator, including the most important part: The expansion coils which get extremely dirty in all buildings and especially in buildings which contain pets; under couches, chairs, sideboards and other furniture which have a ground clearance of "A" or greater.

The crevice tool according to the invention provides the following advantages in relation to already known crevice tools.

a) The debris that is clinging to surfaces will be dislodged by the nubs surrounding the suction slots, allowing it to travel through the air channels and away from the area to be vacuumed.

b) The angle between the socket and the wand allows the user to reach these narrow spaces without having to line up their arm parallel with the space being vacuumed. Typically this negates the need for the user to get down on the floor.

c) The multiple suction slots cover a substantial surface area in length along the wand, thereby passing by much of the surface area of the space being vacuumed in one pass.

d) A further advantage is the flexibility of the tool whereas, if a more acute angle of access is needed to reach a space, the tool will flex to accommodate the required angle of approach.

e) Another advantage is the lateral slots at the end of the tool which will suction out debris in the far-back corners of the space being vacuumed.

A further advantage of the current invention is to modularize its various components, wherein the tool, in kit form, may include a series of associated components, including an adaptor, which connects with an extension, and to the extension the end of the tool includes a widened, flattened, but of thin line construction terminal end, identified as the paw, that can connect with the extension, and provide for the insertion of the crevice tool into rather confined spaces, to accommodate vacuuming means allowing for cleanup of rather confined areas. All of these various components can be interconnected together, and either held by friction, or by locking mechanism, to assure that the components remain into their fixed configuration, during usage, and do not separate when used in rather confined areas.

These and other benefits may become more apparent to those skilled in the art upon review of the details of the invention as provided herein, and upon undertaking a study of the description of its preferred embodiment, in view of the drawings contained herein.

Other variations and modifications to the subject matter of this invention may be considered to those skilled in the art upon review of the invention as described herein. The ideas presented are not intended to limit the scope or application of the device, or its method of usage.

DETAILED DESCRIPTION OF THE PREFERRED EMBODIMENT

Figure 1:
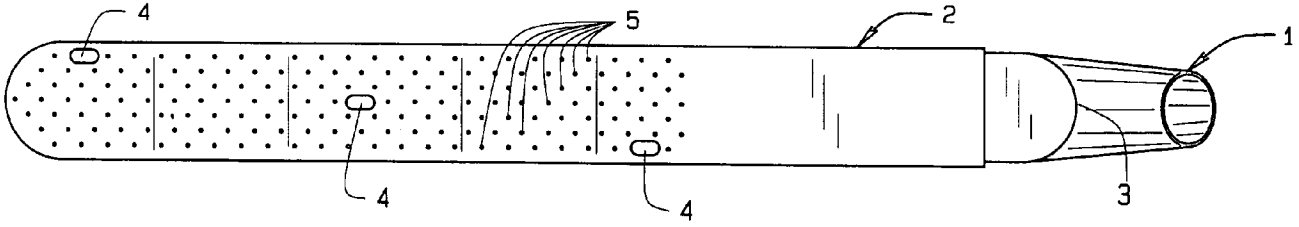
FIG. 1 shows a plan view of the present invention.

FIG. 1 shows the top view of the crevice tool where it can be seen that there is a tapered male end 1 at one end, transitioning into the flat air chamber or of the crevice tool 2, through which debris laden air will pass from the suction slots 4 and 6, through the tapered male end 1 of the tool, and into the vacuum cleaner to which it is attached.

Figure 2:
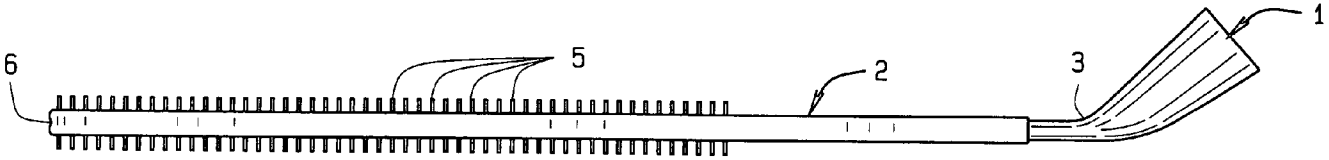
FIG. 2 shows a side view thereof.

FIG. 2 illustrates the nubs 5 protruding from the top and bottom surfaces of the crevice tool 2, which, when raked over a debris ridden surface, will dislodge said debris and, using the air movement caused by the vacuum cleaner through suction transferred to the suction slots 4 and 6, will become air born in the immediate vicinity from where the debris particles were dislodged, causing said particles to move into the air chambers and consequently be removed from the areas being vacuumed.

Figure 3:
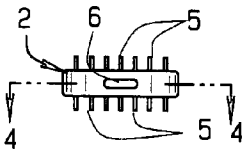
FIG. 3 shows an end view of the invention.

FIG. 3 illustrates the air slit 6 at the end of the invention and an end view of a support rib 7 extending lengthwise inside the air chamber. Not previously mentioned, the supports ribs assist in keeping the airway open for free-flowing, debris laden air, and create the individual air chambers 8 for each set of slots.

Figure 4:
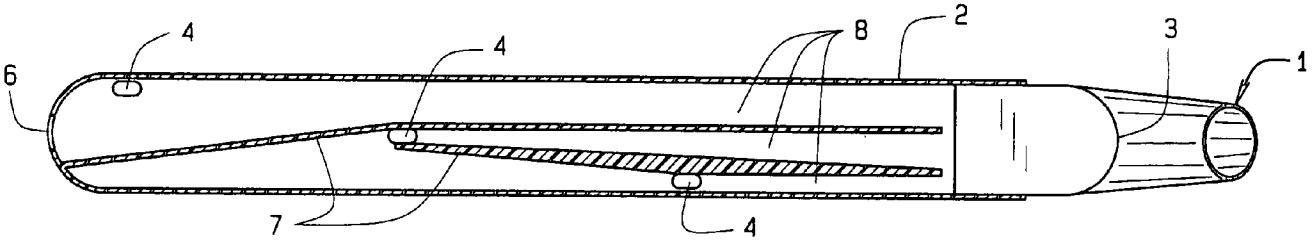
FIG. 4 shows a lateral view of the invention.

FIG. 4 shows a top cutaway view of the invention where it can be seen that there are individual air channels 8 leading from the air slots 4 and 6 to the body of the crevice tool 2, created by the support ribs 7. These individual air channels work to equalize the suction provided to the suction slots.

Figure 6:
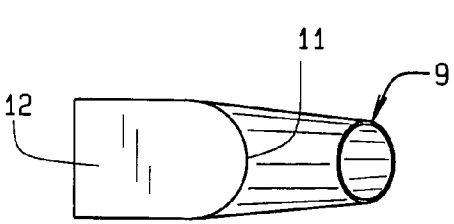
FIG. 6 is a plan view thereof.
Figure 5:
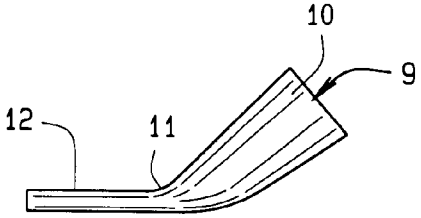
FIG. 5 provides a side view of an adaptor for the kit of this particular crevice tool.

As previously stated, the concept of this invention is to provide a tool for use in vacuuming, where the tool can be applied within tight and confined areas, such as a crevice, or even under a refrigerator, or the like, and not only can roughen up the area, so as to loosen any accumulated dirt or dust, but then function to vacuum up the loosened debris, during the vacuuming process. This particular aspect of the crevice tool can be seen in FIGS. 5 and 6, which includes an adaptor 9 which has a widened configuration at its upper end 10 and which is capable of attachment to the standard vacuum cleaning accessory, usually the length of tube that extends down towards the end where other accessories are applied. The adaptor then continues into a transitional area, and it's angulated, as at 11, and then reasonably flattens, as at 12, into the configuration as noted.

Figure 7:
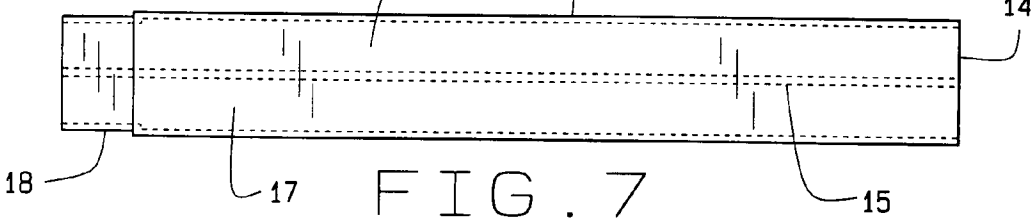
FIG. 7 is a plan view of the extension that is used in assembling the tool for usage.
Figure 8:
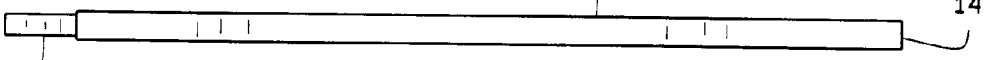
FIG. 8 is a side view thereof.
Figure 9:
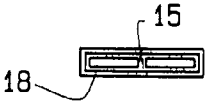
FIG. 9 is a left end view of the extension for the tool.

The adaptor, at its flattened end 12, is then capable of cooperating with an extension 13, the crevice tool 2 or the "paw" 19, as noted in FIG. 7. The extension is designed to provide for insertion of the crevice tool deeply between and into confined spaces, as can be understood. The flattened end 12 of the adaptor accepts the insertion of the other three components into a corresponding end, as can be seen. The extension 13 may include reinforcement, as at 15, internally along its length, either by formed ridges, or a length of integrally molded reinforcement means, to maintain the separation of the flattened extensions 13, as can be noted. Obviously, the extension 13 has at least one channel, internally, as at 16 and 17, for the vacuumed debris to enter therein and pass therethrough, during usage of the vacuuming device. The opposite end of the extension, as at 18, is of a reduced dimension, as can be noted. The reduced dimension provides for its insertion or interconnection with the terminal end of the crevice tool, as to be subsequently described. As can be seen in FIG. 9, the reinforcement means, as at 15, can be seen at the reduced end 18 for the extension 13. Obviously, the reinforcement may be a midpoint wall that extends the length of the extension, or it may be a series of post, molded along its length, that simply provides a reinforcement to maintain the spacing between the upper and lower walls for the extension, during its usage, and to minimize the chance that the extension can be crushed, or pulled by vacuum force into closure, which would be undesirable for the operations of the crevice tool during usage for a vacuuming operation.

Figure 10:
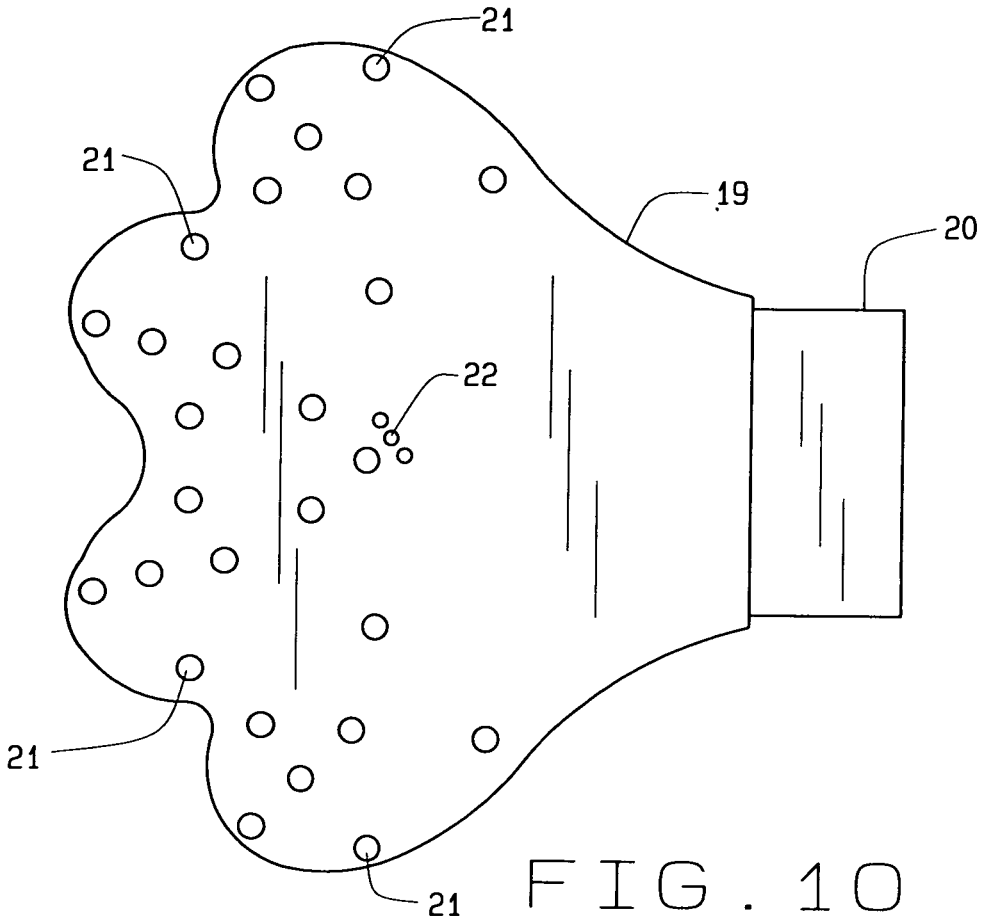
FIG. 10 is a plan view of the terminal end of the crevice cleaning tool.
Figure 11:
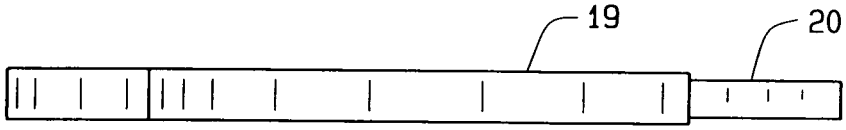
FIG. 11 is a right side view thereof.

FIG. 10 shows a terminal end 19 for the invention. As noted, it does have a paw like configuration, and has a reduced end, as at 20, which can slide into the female end 18 of the extension, when the entire tool is assembled for usage. Then, the end 19 is widened, and affords a series of openings, as at 21, into its interior, that allows for the sucking up of any debris into the terminal end, through the extension, and its adaptor, and into the vacuuming device for disposal. There may be a series of projections, some as shown at 22, that may be provided upon the upper surface, or the lower surface, or both, of the terminal end 19. These projections can also be provided over the entire surfaces of the end, for the purpose of abrasively rubbing against any debris, dust, or other accumulated dirt, that needs to be loosened, and to keep a separation of the openings from flat surfaces to give room for air flow so that the vacuuming device can absorb the loosened dirt into this terminal end 19, through its apertures or ports 21, when vacuuming dirt during usage of the vacuuming device.

Figure 12:
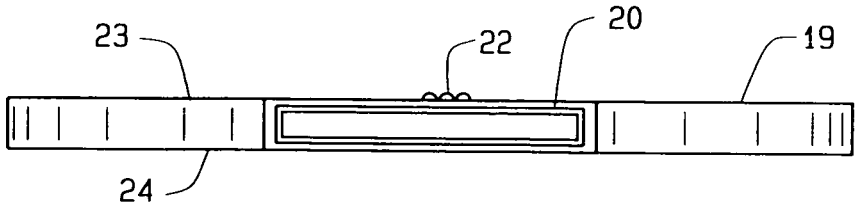
FIG. 12 is a backend view of the terminal end that connects with its extension.

FIG. 12 shows a backend view of the terminal end 19, and shows the reduced end 20, and how it leads into the hollow interior of the end 19, so as to provide for a vacuuming thereat, to draw debris into the end 19, during operations of the vacuuming means. In addition, there may be reinforcement within the end 19, that may provide for maintenance of the spacing between the upper surface 23 and the lower surface 24, of the end, to assure that it is maintained opened, and can attract and draw the removable debris from the area being vacuumed, through the terminal end, the extension of the tool, its adaptor, and into the vacuuming device.

Therefore, it will be understood that the present invention should be interpreted in a broad manner, its breadth being determined only by the terms of the claims.

Obviously, variations or modifications to the subject matter of this invention may occur to those skilled in the art upon review of the summary as provided herein, and upon undertaken a study of the description of its preferred embodiment. Such variations, if within the spirit of this invention, are intended to be encompassed within the scope of any claims to patent protection issuing hereon. The description of the preferred embodiment, in view of the drawings, is set forth for illustrative purposes only.

I claim:

1. A crevice tool attachment for vacuum cleaners comprising:

a wand having multiple air flow entrances;

a number of nubs integrally protruding from the top and bottom of the wand;

a tapered male end as an adaptor extending from the wand at an approximate angle of between about 0° to 60° which will ultimately be attached to the suction hose of a vacuum cleaner.

2. The crevice tool of claim 1 wherein said adaptor extends from the wand at approximately an angle between 10 degrees to 60 degrees.

3. The crevice tool attachment of claim 2 wherein said adaptor extends from the wand at approximate by a 45 degree angle.

4. The crevice tool of claim 1 wherein said wand is of a thin line structure that can fit under refrigerators, between refrigerator coils, under furniture with low ground clearance, between pieces of furniture and walls, under automobile seats, in lint traps on clothes dryers, and therein aids in the evacuation of debris from the identified narrow crevices.

5. A crevice tool attachment for a vacuum cleaning device comprising:

An adapter, for connection with the vacuuming device, an extension connecting with said adapter, said extension having a thin line construction to allow for its location within confined areas during usage, a terminal end for the crevice tool at the end of said extension and attaching at the opposite end of said extension, said terminal end having multiple airflow entrances for removal of debris during a vacuuming function, and a series of protrusions or nubs integrally protruding from one of the top and bottom of the terminal end for use for loosening of dirt and debris during a vacuuming operation, said terminal end is of a wider dimension and is substantially wider than the extension to which it connects, said multiple air flow entrances are provided upon the top and bottom surfaces of the terminal end for the crevice tool.

6. The crevice tool attachment of claim 5, wherein the protrusions integrally protrude from both the top and bottom surfaces of the terminal end for the crevice tool, to aid in the loosening of debris during a vacuuming operation.

7. The crevice tool attachment of claim 5 wherein said extension has a cavity provided internally along its length, and said extension having reinforcement along its length to provide for the opening of its cavity along its length during a vacuuming operation.

8. The crevice tool attachment of claim 7, wherein said terminal end includes upper and lower surfaces, a cavity formed throughout the extent internally of the said terminal end, and reinforcement provided within the terminal end in order to maintain the spacing of its cavity during usage of the tool during a vacuuming operation.

9. The crevice tool of claim 5 wherein said adaptor extends from said extension at an angle between about 0° to 60°.

* * * * *